US009761373B2

(12) United States Patent
Stark et al.

(10) Patent No.: US 9,761,373 B2
(45) Date of Patent: Sep. 12, 2017

(54) METHOD FOR PRODUCING AN INDUCTION COMPONENT AND AN INDUCTION COMPONENT

(71) Applicant: Würth Elektronik eiSos GmbH & Co. KG, Waldenburg (DE)

(72) Inventors: Markus Stark, Altkrautheim (DE); Klaus Richter, Abstatt (DE); Dorian Degen, Crailsheim (DE)

(73) Assignee: Würth Elektronik eiSos GmbH & Co. KG, Waldenburg (DE)

( * ) Notice: Subject to any disclaimer, the term of this patent is extended or adjusted under 35 U.S.C. 154(b) by 0 days.

(21) Appl. No.: 14/896,203

(22) PCT Filed: Mar. 30, 2015

(86) PCT No.: PCT/EP2015/056916
§ 371 (c)(1),
(2) Date: Dec. 4, 2015

(87) PCT Pub. No.: WO2015/161988
PCT Pub. Date: Oct. 29, 2015

(65) Prior Publication Data

US 2017/0032892 A1 Feb. 2, 2017

(30) Foreign Application Priority Data

Apr. 23, 2014 (DE) ..... 10 2014 207 635

(51) Int. Cl.

| | |
|---|---|
| ***H01F 27/02*** | (2006.01) |
| ***H01F 5/00*** | (2006.01) |
| ***H01F 27/28*** | (2006.01) |
| ***H01F 7/06*** | (2006.01) |
| ***H01F 41/04*** | (2006.01) |
| ***H01F 41/10*** | (2006.01) |

(52) U.S. Cl.
CPC ..... *H01F 41/04* (2013.01); *H01F 27/2823* (2013.01); *H01F 41/10* (2013.01)

(58) Field of Classification Search
CPC ..... H01F 5/00; H01F 27/28; H01F 41/04
USPC ..... 336/83, 200, 232; 29/602.1
See application file for complete search history.

(56) References Cited

U.S. PATENT DOCUMENTS

| | | | | |
|---|---|---|---|---|
| 3,142,889 | A | 8/1964 | Austen | |
| 6,759,935 | B2 * | 7/2004 | Moro | B22F 7/08 29/606 |
| 6,791,445 | B2 * | 9/2004 | Shibata | H01F 17/04 336/83 |

(Continued)

FOREIGN PATENT DOCUMENTS

| | | |
|---|---|---|
| CN | 101 901683 A | 12/2010 |
| JP | 2003297661 A | 10/2003 |

(Continued)

*Primary Examiner* — Tsz Chan
(74) *Attorney, Agent, or Firm* — Boyle Fredrickson, S.C.

(57) ABSTRACT

The invention proposes a method of producing induction components. A plurality of coils are embedded, with predetermined orientation of the coil ends, in a block made of in particular pulverulent substrate. The block is positioned on a plate having a marking for each coil. The combination made up of block and plate is pressed. The winding ends are exposed by milling and provided with contacts. The block is then sawn up mechanically into individual elements each containing a coil.

15 Claims, 3 Drawing Sheets

(56) References Cited

U.S. PATENT DOCUMENTS

| | | | | |
|---|---|---|---|---|
| 7,415,757 | B2 * | 8/2008 | Satoh | A61B 8/08 29/602.1 |
| 8,695,209 | B2 * | 4/2014 | Saito | H01F 27/292 29/602.1 |
| 2001/0016977 | A1 | 8/2001 | Moro et al. | |
| 2002/0158739 | A1 * | 10/2002 | Shibata | H01F 17/04 336/90 |

FOREIGN PATENT DOCUMENTS

| | | | |
|---|---|---|---|
| JP | 2005026495 | A | 1/2005 |
| KR | 101044607 | B1 | 6/2011 |
| KR | 101044608 | B1 | 6/2011 |
| KR | 20110100096 | A | 9/2011 |

* cited by examiner

METHOD FOR PRODUCING AN INDUCTION COMPONENT AND AN INDUCTION COMPONENT

The invention relates to a method of producing an induction component and to an induction component produced by this method.

A method of producing an induction component or inductor is already known (KR 10-1044607). A coil core, a coil casing and a cover made of a metallic magnetic powder are produced here and pressed in a mould with the previously wound coil. The winding ends are located in the region of the end side of the inductor thus produced.

In the case of a further known method (KR 10-1044 608), a multiplicity of connection, terminals are incorporated in a first mould and a multiplicity of individual coils are incorporated in a second mould. The two moulds are positioned one upon the other and the coil connections are welded to the connection terminals.

In the case of yet a further known method (KR 10-2011-0100096), a coil core, coil casing and coil cover are pressed in a mould together with the coil. Electrical contact is made at the winding ends, which are located in the end surface of the resulting inductor, by sputtering.

It is an object, of the invention to provide a method of producing induction components which gives rise to high-quality induction components and is easy to carry out.

In order to achieve this object, the invention proposes a method having the features mentioned in claim 1. Developments of the invention form the subject matter of dependent claims.

The method thus provides for individual coils to be wound. These coils may be of any desired shape. The wire used for this purpose may likewise have any desired cross section. A block made of an in particular pulverulent and/or ferromagnetic substrate is produced, and the coils are embedded therein with predefined orientation. It is ensured here that the winding end which forms the start of the winding has a certain orientation in relation to the block. A pre-pressing operation then takes place in order to produce a certain level of homogeneity within the block and to fix the coils spatially within the block.

The pre-pressed, block is positioned on a plate, which has a marking for each coil. The marking is assigned in particular to the start of the winding. The combination made up of block and plate is pressed. The substrate of the block here is compacted and, inter alia, an impression of the marking is generated in that side of the block which is assigned to the plate. The marking indicates to us the orientation of the coil and, in particular, the position of the start of the winding of the coils. It is preferably the case that the coils and the associated markings are arranged at predetermined spacings. The surface of the block may be subdivided into non-overlapping regions, each region being assigned to precisely one coil. The markings, then, are arranged such that they end up located in each case within a region which is assigned to a specific coil. The markings are advantageously arranged such that, once the block has been divided up into induction components, each induction component has an impression of a marking on its upper side. The upper side of the induction component is located opposite an underside of the induction component with the connection contacts and/or winding ends exposed.

The pre-pressing operation can take place isostatically, in order to compact the substrate of the block in as homogenous and crack-free a manner as possible.

Following the pressing operation, the block is released from the bearing plate and the ends of the coil windings are exposed. In the case of a cross-sectionally round winding wire, it is also possible for up to approximately half the cross section of the wire to be removed.

The exposed ends of the coil windings are provided with connection contacts.

The block is divided up to form the induction components each containing at least one coil or a double coil.

If desired in any individual case, it is also possible for the block to be divided up into induction components containing more than one coil.

In a development of the invention, provision can be made for the block to be formed by virtue of ferromagnetic powder being pressed in a pressure procedure. For example, use can be made of an iron-powder mixture having an iron fraction of for example 98%.

In a development of the invention, the winding ends of the coil, at which electrical contact has to be made, can be bent such that their end region runs transversely to the axis of the coil.

In particular, provision can be made for the winding ends to project beyond the outer contour of the coil body.

In yet a further development, provision can be made according to the invention for use to be made, for producing the coils, of insulated wire, in particular enamel-insulated wire.

It is possible, and falls within the context of the invention, for a coil to be provided with a core before being embedded in the block. This core can also be used for example as a holder for the wire during the winding operation. In this case, the wire is thus wound up onto the core.

It likewise falls within the context of the invention for the coil to be wound without a core and to be embedded in the block without a core. In this case, the coil core can be formed by the introduction of the substrate powder into the interior of the coil and the subsequent pressing operation.

In order to carry out the pre-pressing operation, provision can be made for the block or the substrate with the coils inserted to be incorporated in a moulding press and for a pre-pressing operation to be carried out in this moulding press.

The pre-pressing operation can preferably take place in accordance with a time/pressure profile. This profile is selected here such that there is no damage to the insulation of the wire of the coils or to the coils themselves.

It was mentioned in the introduction that the block with the coils incorporated therein is positioned on a bearing plate prior to the isostatic pressing operation being carried out. That side of the block which is located on the bearing plate later forms the upper side of the induction component, which is thus located opposite the underside, which is intended for being applied to the printed circuit board. Using a bearing plate having a low level of surface roughness ensures that the upper side of the induction component is likewise smooth. This improves the possibility of picking and placing the induction components with the aid of a suction gripper. For example, use is made of a bearing plate with a surface roughness of R=0.1 μm or less, as a result of which it is possible to use very small suction grippers.

In the development of the invention, prior to the isostatic pressing operation being carried out, a material layer made of an elastic material, for example a silicone mat, is positioned on that side of the block on which the winding ends of the coils are located. This is intended to avoid, during the isostatic pressing operation, disadvantageous deformation of the underside of the resulting induction components, particularly in the region of the winding ends and thus of the subsequent wire outlet.

In a development of the invention, provision can be made for the unit made up of bearing plate, pre-pressed block and the layer of elastic material to be evacuated in a gas-tight manner and to be introduced into a liquid-filled pressure vessel, in which the isostatic pressing operation is carried out under a certain pressure and/or at a certain temperature. The pressure and/or the temperature can follow a predetermined time course.

Following completion of the isostatic pressing operation, the operation of exposing the winding ends can take place mechanically, not just the insulation of the winding ends being removed, but also the wire possibly being provided with a greater contact-making surface. For example, the operation of exposing the winding ends can take place by milling, possibly a round winding wire having up to half its cross section milled away.

Electrical contact is then made at the exposed winding ends using a known method.

The following operation of dividing up the block containing the multiplicity of coils can be carried out with the aid of known methods, for example by the block being sawn up mechanically.

Further features, details and advantages of the invention can be gathered from the claims and the abstract, the wording of both is incorporated to the contents of the description by reference, from the following description of preferred embodiments of the invention and with reference to the drawing, in which;

The method proposed by the invention will now be explained with reference to an example.

Figure 1:
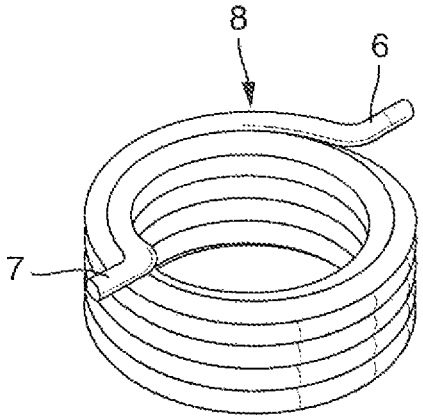
FIG. 1 shows a perspective view of a coil.

FIG. 1 shows the perspective view of a coil 8, which has the winding ends 6, 7 at its one axial end, illustrated at the top in FIG. 1. The two winding ends 6, 7 are bent such that they run transversely to the axis of the coil 8 and project outwards beyond the outer contour of the coil 3. The two winding ends 6, 7 also run along a diameter of the coil. The coil 8 has two layers of windings arranged one inside the other.

Figure 2:
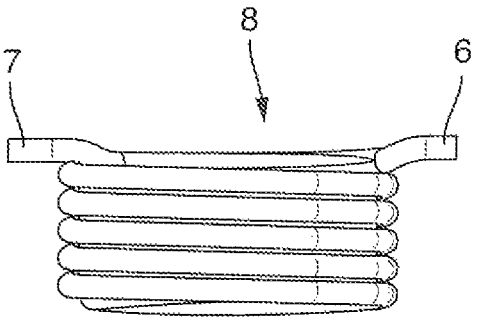
FIG. 2 shows the side view of the coil from FIG. 1.

FIG. 2 shows the coil 8 from FIG. 1 from the side. It can also be seen here that the winding ends 6, 7 of the coil-forming winding project beyond the outer contour of the coil, and are located in a common plane.

Continuing the method, then, the plurality of coils 8 are embedded in a block made of a substrate, wherein the substrate is formed in particular from a powder, in particular an iron-powder mixture.

Figure 3:
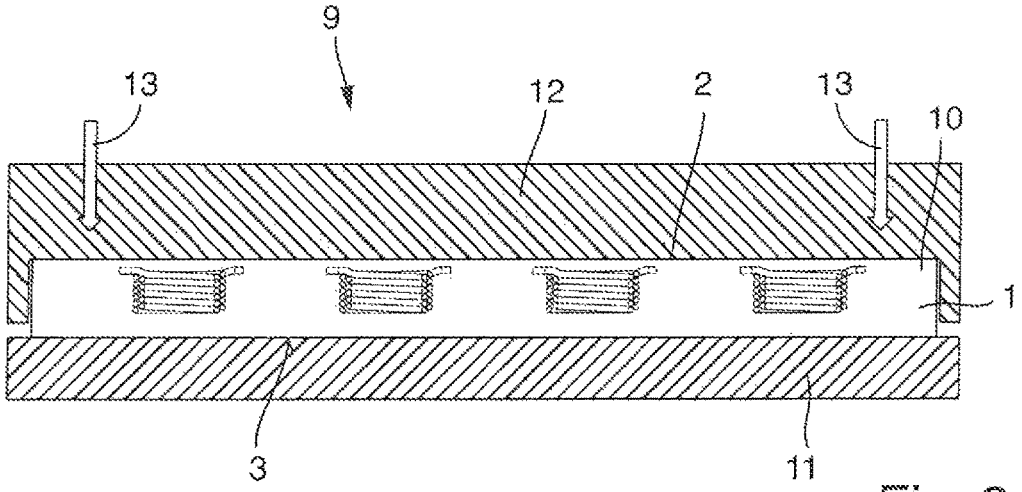
FIG. 3 shows a section through the block, with coils incorporated therein, during the pre-pressing operation.

FIG. 3, then, shows the arrangement of a block 1 in a moulding press 9, wherein the block 1, prior to the press being closed, can consist of a first substrate powder. For the operation of embedding the coils in the block 1, it is ensured that the winding ends assume a certain orientation in relation to the side edges of the block 1. The winding ends 6, 7 are located in a layer 10. The block 1 is located on a support plate 11 in the moulding press. The upper part 12 of the moulding press 9 is pressure-activated in the direction of the arrows 13, wherein the course taken by the pressure corresponds to a time/pressure profile. This profile is selected such that the energy absorbed cannot result in damage to the wire insulation or to the pre-pressed structure. It is possible, for example, for a pressure of 250 kg/cm$^2$ to be applied during this pressing operation of the first substrate powder. If appropriate, in order to maintain desired dimensions of the block 1, it is possible, following the first pressing operation, for a second substrate powder to be applied to the block 1 and for a second pressing operation to take place. If necessary, in order to achieve desired dimensions of the block 1 or of the induction components produced therefrom in the moulding press 9, it is possible for the block 1 to be provided with a further layer made of substrate powder, this layer then being pressed. The substrate powder here may be the same as, or different from, the first substrate powder. Using different substrate powders, with differently magnetic properties, for the individual pressing operations makes it possible to set a desired level of inductance for the induction components produced. It is possible, for example, for a pressure of 200 to 270 kg/cm$^2$ to be applied during this second pressing operation. Once the amount of time corresponding to the profile has elapsed, the operation of pre-pressing the block 1 with the coils 8 has thus been completed.

Figure 4:
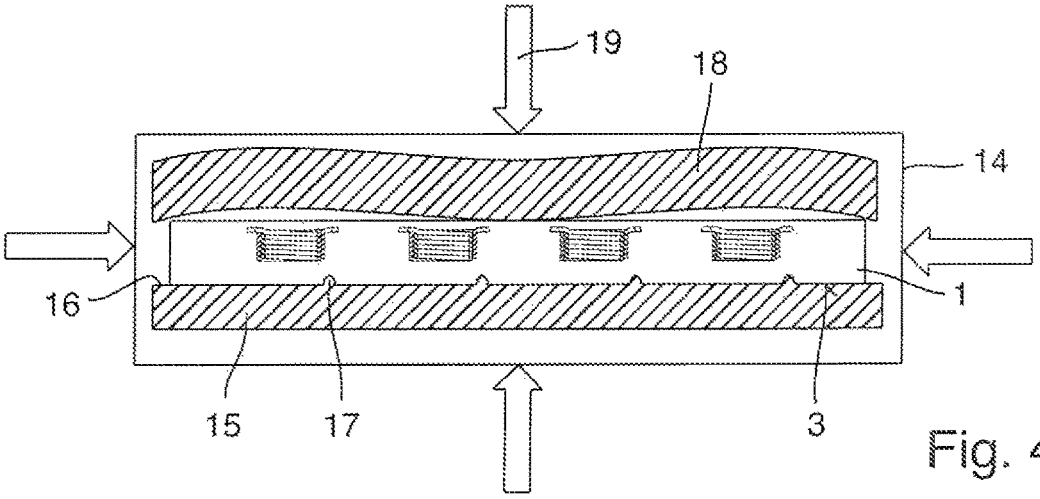
FIG. 4 shows the isostatic pressing operation.

The block 1 is then removed from the moulding press 9 from FIG. 3 and introduced into a pressure vessel 14, which is illustrated schematically in FIG. 4. The pressure vessel 14 contains a bearing plate 15 with an upper side which is directed towards the block 1 and of which the surface quality does not exceed a roughness of 0.1 μm, it therefore being possible for said bearing plate also to be referred to as a polished plate. Said upper side 16 contains, for each coil 8, a protrusion 17 which is in the form, of a small cone and forms a marking. Each of the cones 17 is associated with the orientation of the winding ends 6, 7 of the respective coil 8, in particular with the start of the winding. In other words, the start of the winding of each coil 8 is located opposite a respective cone 17. The block 1 is positioned in an approximately oriented manner on the bearing plate 15. A silicone layer 18 is then positioned on the layer 10, which has been applied to the upper side 2 of the block 1. The unit made up of block 1, bearing plate 15 and silicone layer 18 is then expediently packed in a liquid-tight manner and, if appropriate, evacuated. Thereafter, the pressure vessel 14 is completely filled with liquid, for example with water, and is subjected to pressure on all sides, as is indicated, by the arrows 19. The silicone layer 18 should prevent damage to the winding ends 6, 7, which are contained in the layer 10, during pressure activation. The pressure activation causes the cones 17 to generate a complementary depression 21 in the underside 3 of the block 1. The pressure is significantly higher, for example around at least ten times the pressure, in particular 4500 kg/cm$^2$, during the isostatic pressing operation than during the preceding pressing operations. The isostatic pressing operation can advantageously follow a temperature and pressure profile over a time.

During the pressure-activation operation, temperature activation can also take place. The pressure activation advantageously fakes place in accordance with a predetermined time/pressure profile. The temperature activation can likewise follow a predetermined time/temperature profile.

Following completion of the isostatic pressing operation, the resulting block provided with the layer 10 is removed from the pressure vessel 14. The coils 8 are fully embedded in the block 1. The underside 3 of the block 1 has formed in it the depressions 21 which are produced by the cones 17; each constitute a marking and are located opposite the respective start of the winding of the coils 8.

Figure 5:
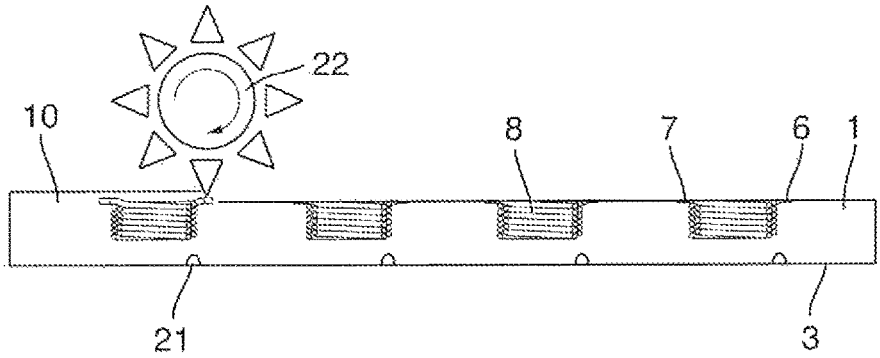
FIG. 5 shows the method step of exposing the winding ends of the coils.

Next, the upper side of the layer 10, which can still be seen at the left-hand end of FIG. 5, is removed with the aid of a milling cutter 22 to the extent where the winding ends 6, 7 of each coil 8 are freed of their insulation and in particular up to approximately half the cross section thereof is exposed. This is illustrated in the right-hand part of FIG. 5.

Figure 6:
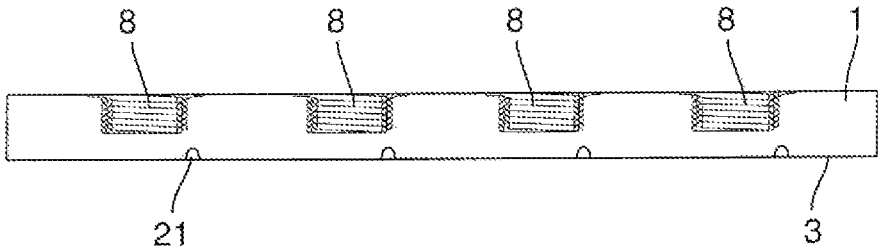
FIG. 6 shows the result of the operation of exposing the winding ends.

The result is a block 1, see FIG. 6, in which the winding ends 6, 7 of all the coils 8 have been exposed. These winding ends 6, 7 can then be provided, by way of a known method, with connection contacts.

Figure 7:
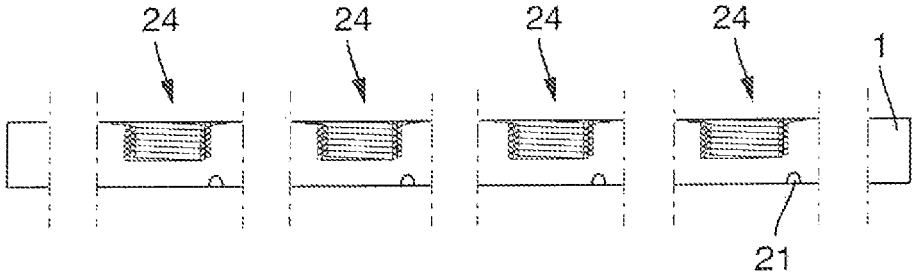
FIG. 7 shows the induction components produced by the block being divided up.

Thereafter, the induction components, which are the desired end products, are produced by virtue of the block 1 being divided up, see FIG. 7. Proceeding from FIG. 6, FIG. 7 shows how individual inductors 24 are produced from the continuous block 1 by virtue of the latter being sawn up.

Figure 8:
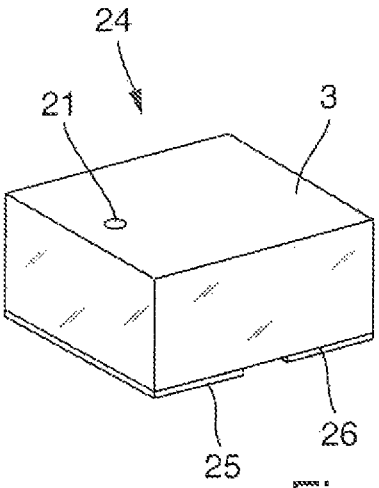
FIG. 8 shows the perspective view of an induction component according to the invention.
Figure 9:
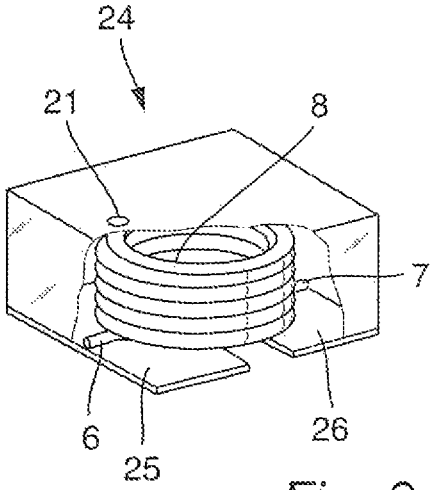
FIG. 9 shows the induction component from FIG. 8 in a partially open state.

The following figure, FIG. 8, shows a perspective view of an inductor 24. The former underside 3 of the block 1 now forms the upper side of the inductor 24. This upper side can be seen to contain a hole 21, which has been generated by the cone 17 of the support plate 15. Two connection-contact elements 25 are applied to the former tipper side of the block 1, said former upper side forming the under side of the inductor 24, and are connected electrically and mechanically to a respective winding end 6, 7. This connection between the contact elements 25 and the winding ends 6, 7 is indicated in FIG. 9, which does not illustrate the substrate, which actually tightly encloses the coils 8. Since it has been pressed by means of the polished bearing plate 15, the upper side of the inductor has a very low level of surface roughness and can therefore be gripped reliably for pick-and-place purposes by extremely small suction grippers. Typically, the inductor 24 has an edge length between approximately 1 mm and 5 mm. The hole 21, which is designed in the form of a conical blind hole, is an indication of the orientation of the start of the winding, and therefore the induction component 24 can be positioned automatically with desired orientation of the start of the winding.

The invention claimed is:

1. A method of producing induction components (24), having the following method steps:

a multiplicity of individual coils (8) with the two ends (6, 7) of the windings projecting out of the coil body are produced;

each coil (8) of the multiplicity of coils (8) is embedded, with predetermined orientation of the winding ends (6, 7), in a block (1) made of a pulverulent substrate:

the block (1) is positioned on a plate (15) having a marking (17) for each coil (8), wherein the number of markings (17) corresponds to the number of coils (8):

the combination made up of block (1) and plate (15) is pressed, the block (1) is then divided up into individual induction components (24).

2. The method as claimed in claim 1, characterized in that the markings (17) are arranged such that, once the block (1) has been divided up into individual induction components (24), each induction component (24) has an impression of a marking (17) on its upper side, wherein the upper side is located opposite an underside of the induction component (24) with winding ends exposed.

3. The method as claimed in claim 1, characterized in that the markings (17) are arranged such that the markings (17) end up located in each case within a surface region of the block (1) which is assigned to a respective coil, wherein the surface regions of the block (1) which are assigned to the individual coils do not overlap.

4. The method as claimed in claim 1, wherein the block (1) is pre-pressed and the pre-pressed block is positioned on the plate (15).

5. The method as claimed in claim 4, wherein the pre-pressing operation takes place in accordance with a time/pressure profile.

6. The method as claimed in claim 1, wherein the combination made up of block (1) and plate (15) is pressed isostatically.

7. The method as claimed in claim 1 having the following method steps:

following the, in particular isostatic, pressing operation, the ends (6, 7) of the coil windings are exposed, the exposed ends (6, 7) of the coil windings are provided with connection contacts;

the block (1) is then divided up to form the individual induction components.

8. The method as claimed in claim 1, wherein the operation of exposing the winding ends (6, 7) takes place mechanically.

9. The method as claimed in claim 1, wherein the winding ends (6, 7) are bent such that they run transversely to the axis of the coil.

10. The method as claimed in claim 1, wherein the winding ends (6, 7) project beyond the outer contour of the coil body.

11. The method as claimed in claim 1, wherein a coil (8) is provided with a core prior to being embedded in the block (1).

12. The method as claimed in claim 1, wherein, use is made of a plate (15) with a low level of surface roughness, in particular R 0.1 μm or less.

13. The method as claimed in claim 1, wherein prior to the isostatic pressing operation, a layer made of elastic material is positioned on the side (2) of the block (1), said side being located opposite the plate (15).

14. The method as claimed in claim 1, wherein the isostatic pressing operation is carried out in a liquid-filled pressure vessel (14).

15. An induction component (24) with a coil (8), produced by a method as claimed in claim 1 wherein the induction component (24) has an impression of a marking (17) on its upper side, wherein the upper side is located opposite an underside of the induction component (24) with winding ends exposed, and wherein the impression is designed in the form of a hole (21), which is an indication of the orientation of the start of the winding.

* * * * *